United States Patent [19]

Wehle

[11] Patent Number: 4,462,158

[45] Date of Patent: Jul. 31, 1984

[54] HAND-GUIDED MOTOR DRIVEN WORKING DEVICE

[75] Inventor: Anton Wehle, Fellbach, Fed. Rep. of Germany

[73] Assignee: Andreas Stihl, Waiblingen, Fed. Rep. of Germany

[21] Appl. No.: 406,081

[22] Filed: Aug. 6, 1982

[30] Foreign Application Priority Data

Aug. 7, 1981 [DE] Fed. Rep. of Germany ..... 3131382

[51] Int. Cl.[3] ..... B27B 17/00

[52] U.S. Cl. ..... 30/381; 123/516

[58] Field of Search ..... 123/516; 30/381, 382, 30/383; 55/310

[56] References Cited

U.S. PATENT DOCUMENTS 2,222,274 11/1940 Antonsen ..... 123/516

2,579,023 12/1951 Thomas ..... 123/516

2,894,530 7/1959 Stevens ..... 55/310 X 2,955,628 10/1960 Wensloff ..... 30/381

3,783,590 1/1974 Allen ..... 55/310

*Primary Examiner*—Jimmy C. Peters

*Attorney, Agent, or Firm*—Walter Ottesen

[57] ABSTRACT

A hand-guided, motor driven working device with at least one working tool, especially a portable power chain saw. The device has a venting device for the fuel tank, with the venting device comprising a flexible tube, which projects from the upper part of the tank chamber. The free end of the tube is closed except for a labyrinth-like passage or opening. The tube is arranged at least partially within a covering or sheathing, and the tube is guided to an essentially dirt- and contamination-free chamber located as far as possible from the tank, the tool, and the motor.

16 Claims, 7 Drawing Figures

HAND-GUIDED MOTOR DRIVEN WORKING DEVICE

FIELD OF THE INVENTION

The present invention relates to a hand-guided, motor driven working device with at least one working tool, especially a portable power chain saw; the device has a venting device for the fuel tank, with the venting device comprising a flexible tube which projects from the upper part of the tank chamber, with the free end of the tube being closed except for a labyrinth-like passage or opening.

BACKGROUND OF THE INVENTION

With a power chain saw of this type, the tube projects upwardly out of the tank, and the opening is formed by an externally threaded screw inserted in the free tube end. Fuel can discharge via this tube or the opening during an overpressure in the tank, and fresh air can be drawn in for aeration.

Although the free tube end is not in the immediate vicinity of the saw guide bar and of the motor, it is not that far from these parts that it could not be contaminated or clogged by dirt or contaminants from the surrounding air, especially by dust formation during working or the like, or by exhaust gases. The thread consequently can clog or become obstructed more or less rapidly, so that the aeration and venting of the tank is disrupted. Additionally, the thread can also become dirty or contaminated via contaminants in the fuel, because the fuel relatively frequently drips out of the passage or opening in spite of the upwardly directed position of the tube.

SUMMARY OF THE INVENTION

It is an object of the present invention to construct an apparatus of this type in such a way that a clogging or contamination of the passage or opening is avoided, and a disturbance-free aeration and venting of the fuel tank is always assured.

The device of the present invention is characterized primarily in that the tube is arranged at least partially within a covering or sheathing, and in that the tube is guided to a chamber which is essentially free of dirt or contamination, and which is located as far as possible from the tank, the tool, and the motor.

The inventive positioning of the free tube end at a great distance from the motor and from the tank, as well as from the tool itself, considerably reduces the danger of contamination or clogging of the passage or opening because the free end lies externally of the regions in which most of the dirt and dust collects. Additionally, the fuel discharge at the free tube end is made considerably more difficult as a result of the great distance of the free tube end from the tank, so that hardly any fuel at all reaches the passage or opening, or discharges therefrom only sporadically. Impurities or contaminants in the fuel therefore do not lead to a notable danger of clogging or contamination of the passage or opening, so that the free supply cannot be affected. In spite of the great distance of the free tube end from the tank, and in spite of the relatively long tube length, the tube can be installed protected via the covering or sheathing at least at free and open, locations whereat damage could otherwise easily occur. By arranging the free tube end within a covering, which can for example also be formed by a filter, a further important advantage is attained in that the covering itself forms the dirt or contaminant-free chamber, so that the admission of dust and dirt particles can even be completely prevented. Moreover, due to the inventive positioning of the free tube end, it is also possible to completely prevent droplets of fuel which discharge from the passage or opening from coming into contact with the tool or with the motor and being ignited.

According to specific features of the present invention, the dirt or contamination-free chamber may be formed by the covering, at least in the region of the free tube end. The free tube end may be guided via at least one direction-changing location into the dirt or contamination-free chamber in such a manner that at least one tube segment in at least one operating position of the device forms a standpipe or riser for fuel leaving the tank chamber. At least two, preferably three riser segments may be provided, and are disposed approximately at right angles, preferably U-shaped, with respect to each other.

The contamination or dirt-free chamber may be located externally of the motor housing. The tube may be located essentially completely within the covering. The covering may be formed by a carrying handle, or may be formed by a protective guard of the device.

The tube may open at the greatest possible distance from the horizontal grip of the approximately U-shaped carrying handle at the highest location in the tank.

The free tube end may be surrounded at least partially by a filter.

The free tube end may project into an open segment which in the out-of-operation state of the device opens below the motor and/or the tool.

At least that tube segment connected to the tank is located in a housing chamber which in the normal position of the device is disposed above the motor housing and between the tank and the hand guard.

A connector piece of the tube which communicates with the tank may have an insert which essentially completely fills the open cross section in such a manner that at least one labyrinth-like passage or opening is formed for the fuel and/or the outside air. The insert may be formed by a screw with an outer thread and a diameter, measured at the base of the thread, which is slightly smaller than the smallest inside diameter of the tube. The free end of the tube may have a second passage or opening which is made identical to the passage or opening at the tank.

At least the free tube end may be disposed in a chamber located above the tank.

BRIEF DESCRIPTION OF THE DRAWING

The invention will now be described with reference to the drawing wherein.

DESCRIPTION OF THE PREFERRED EMBODIMENTS OF THE INVENTION

Figure 1:
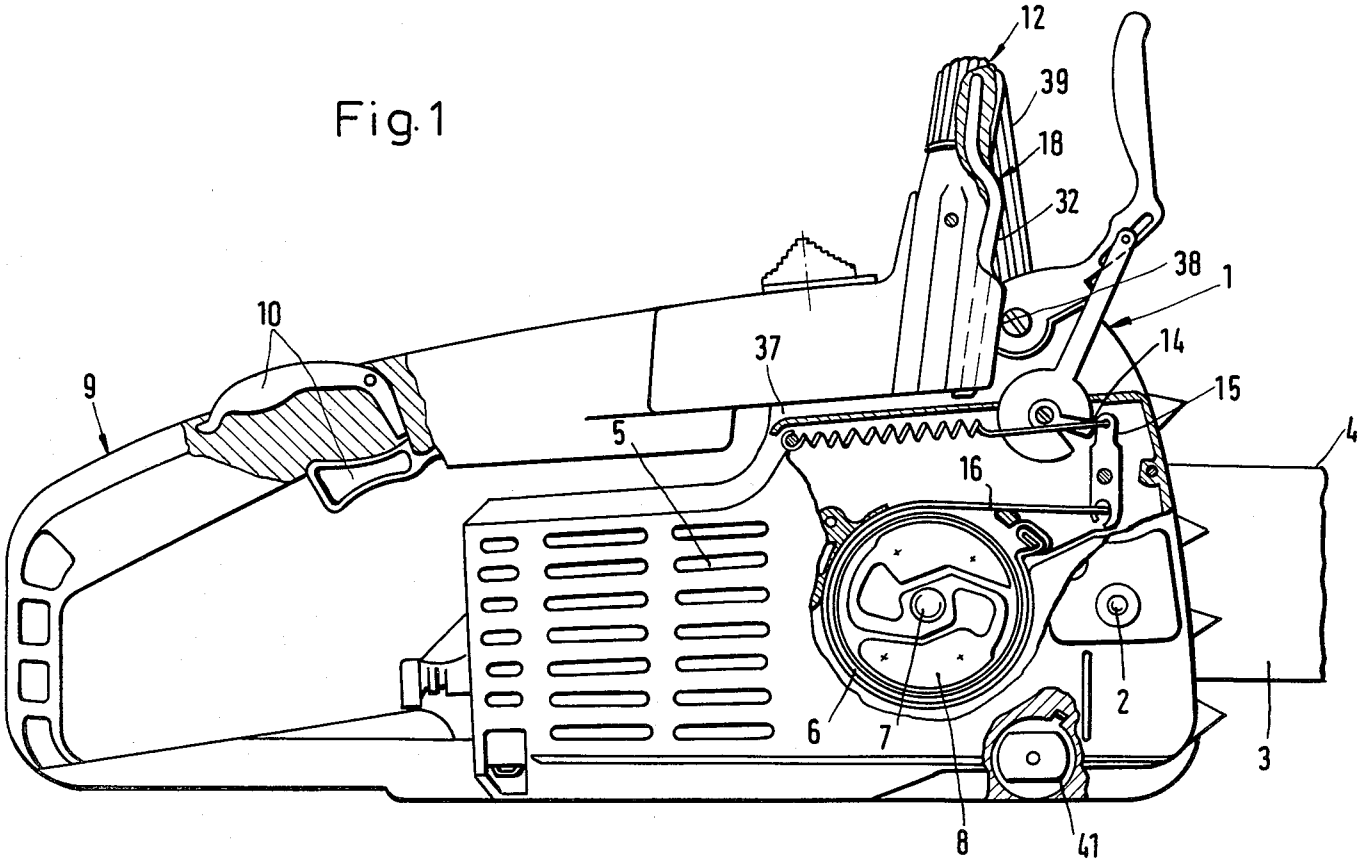
FIG. 1 is a side view partially broken away and in section to illustrate one embodiment of a portable power chain saw having features in accordance with the present invention.

Referring now to the drawings in detail, the two power chain saws according to FIGS. 1 through 7 essentially comprise a motor housing 1, in which a guide bar 3, about which circulates a finite saw chain 4 (illustrated in a simplified manner) is fastened or held by screws at 2 (FIG. 1). The housing 1 accommodates an internal combustion engine 5, which serves as a drive motor for the saw chain 4, and also accommodates a rotatably mounted coupling or clutch drum 6 of a centrifugal clutch. Flyweights 8 are rotatably connected with the crankshaft 7 of the motor 5; these flyweights 8 come into frictional engagement with the centrifugal clutch as soon as the motor 5 has attained a predetermined operating speed. In this engagement position the saw chain 4 is driven by the drum 6 via a non-illustrated drive gear or pinion secured to the outer side thereof.

The housing additionally supports a handle 9 which is mounted in such a way as to be protection against vibration; the handle 9 is provided with installed operating or control elements 10 for the motor 5, and extends in a direction opposite to that of the guide bar 3. With the construction according to FIGS. 1 through 5, this handle 9 is arranged on a special handle housing 11 (FIG. 5). For safe and reliable handling of the saw, a further carrying handle 12, which extends transverse to the guide bar 3, is fastened to the saw housing 1 or handle housing 11.

To avoid accidents caused by kickbacks or recoils of the saw chain 4, the illustrated power chain saws have a safety brake device with a hand guard handle 13 which is located transverse to the guide bar 3, and is pivotally mounted between the guide bar 3 and the handle 12. This hand guard 13 is mounted in such a way that it acts as an inertial mass or dead weight. For this purpose, the hand guard 13 surrounds with play a drag lever 14 which is rotatable with the hand guard and is pre-stressed in the operating position thereof against a movable mounting 15. This drag lever 14 is connected with a brake band 16 which surrounds the clutch drum 6 with play in the operating position thereof.

Figure 3:
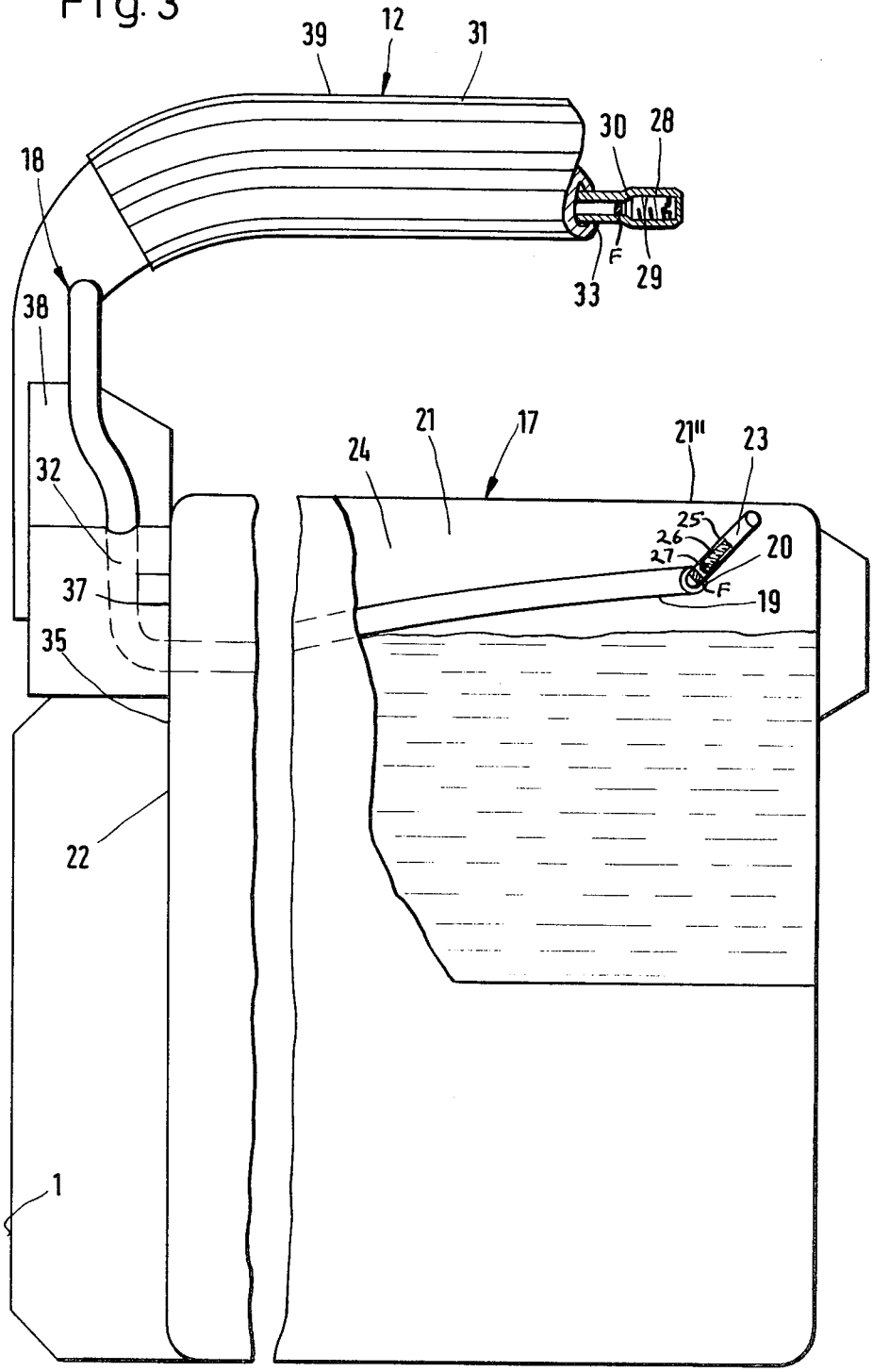
FIG. 3 is a schematic illustration of the course or path of a tube from a tank into a carrying handle of the device, partially broken away and partially in section.
Figure 4:
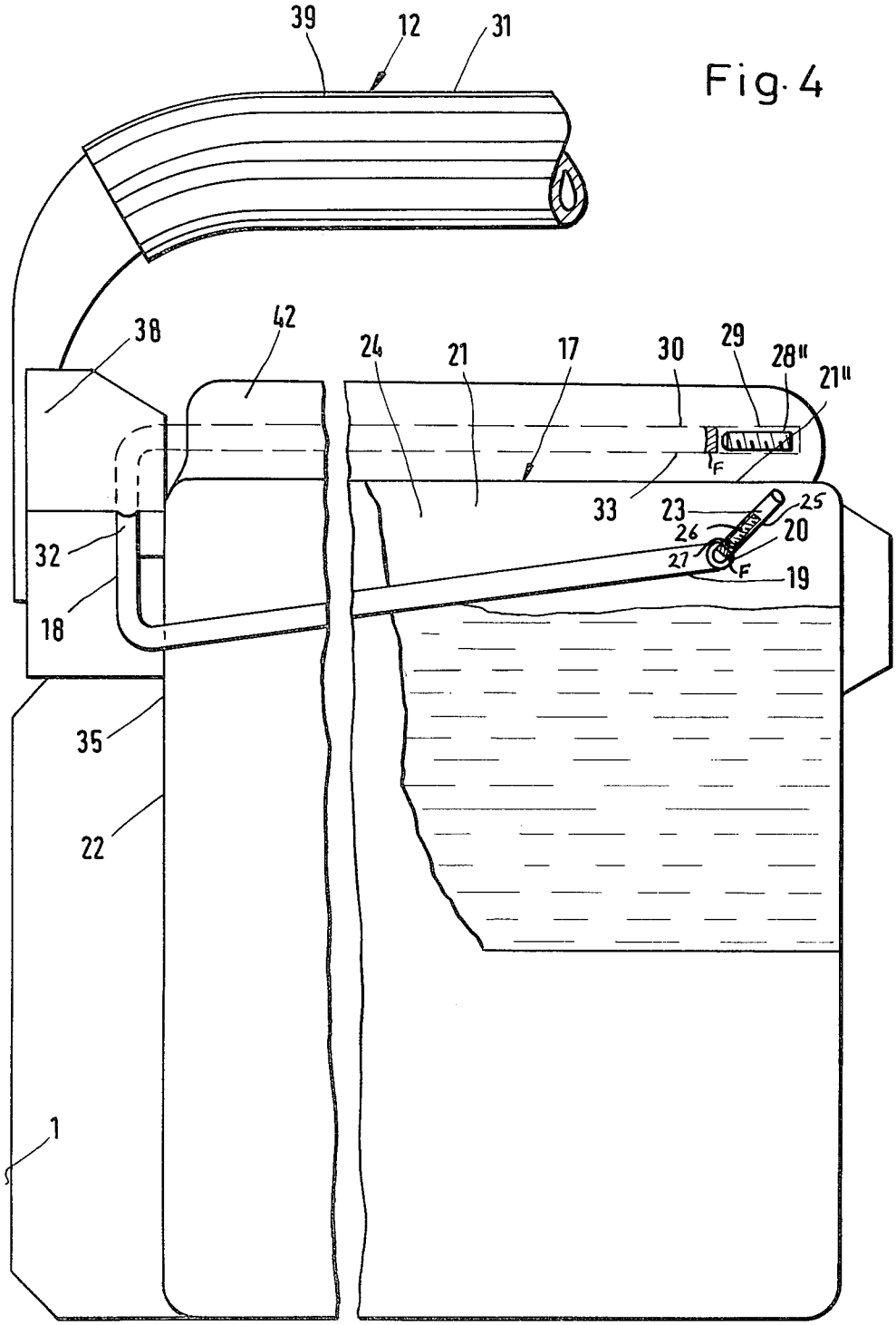
FIG. 4 is an illustration similar to that of FIG. 3, but with the tube being guided from the tank into a separate chamber located above the tank.
Figure 5:
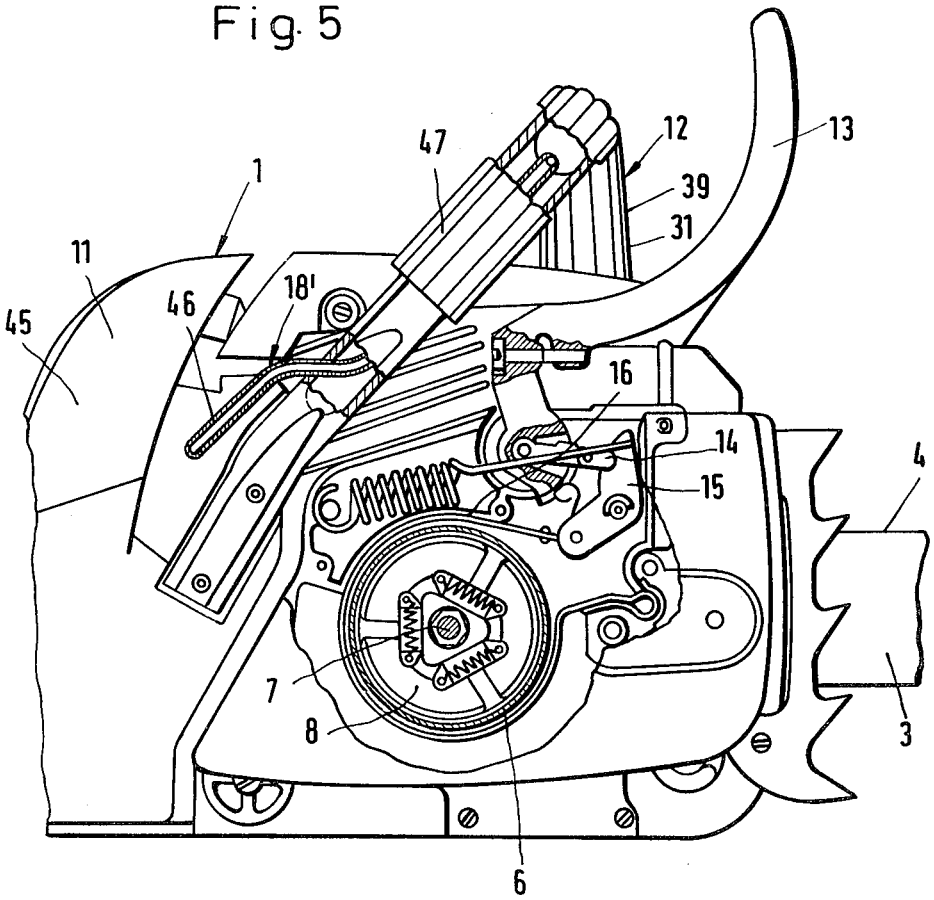
FIG. 5 shows a second embodiment having features of a power chain saw in accordance with the present invention in an illustration similar to that of FIG. 1.
Figure 6:
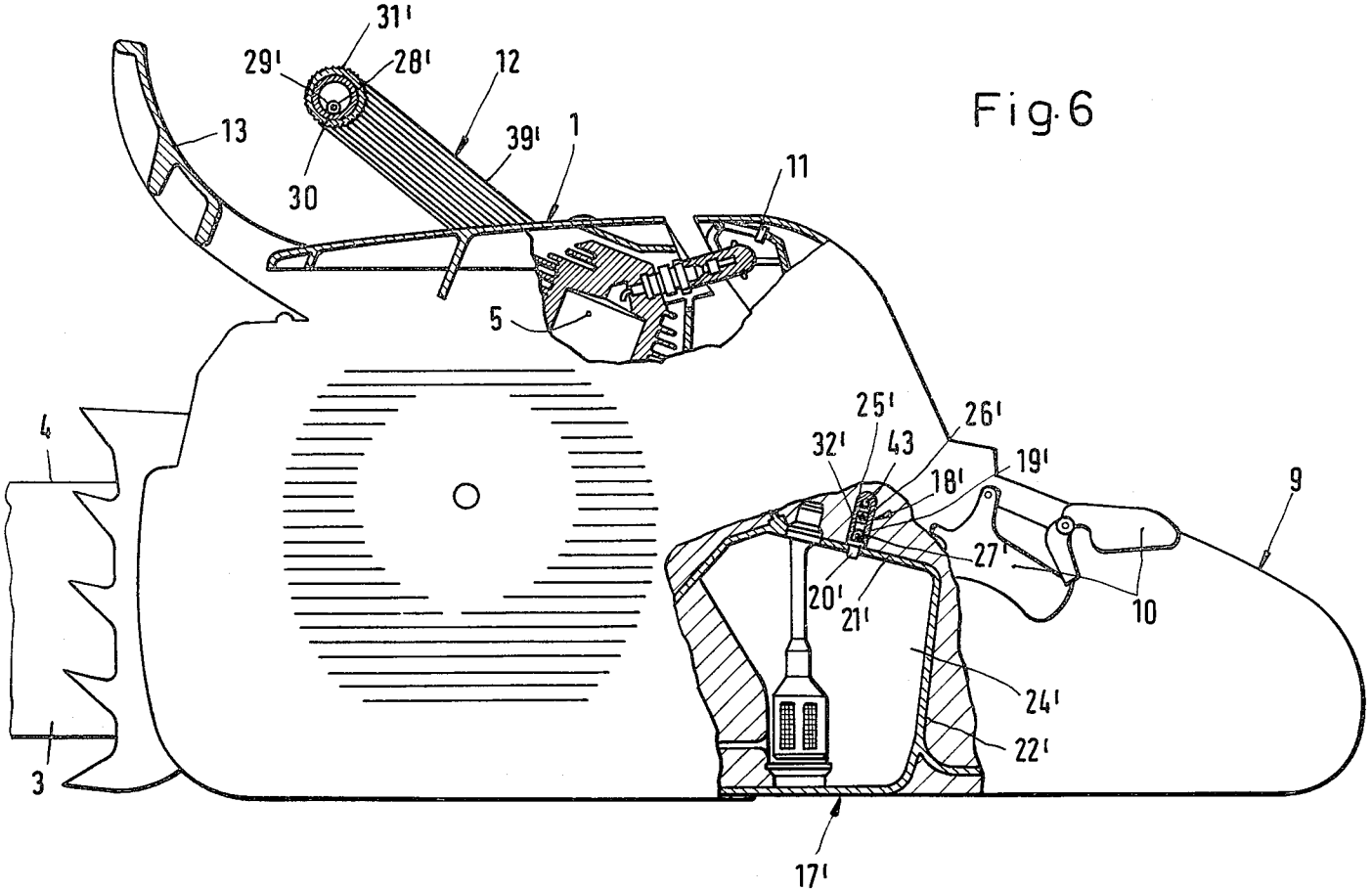
FIG. 6 shows the power chain saw of FIG. 5 from the other side.

FIGS. 3, 4 and 6 show a tank 17, 17′ of the associated power chain saw; the tank has a tubular venting device 18, 18′.

The pipe or tube 18, 18′ is a hose made of flexible material; one end 19, 19′ of the tube 18, 18′ is seated on a nipple or connection 20, 20′. The nipple 20, 20′ is forced, screwed, or adhesively fastened in an upper wall 21, 21′ of the associated tank housing 22, 22′. In the embodiment according to FIGS. 1 through 4, the free nipple opening 23 of the nipple 20, in the normal position of the power chain saw (see FIGS. 1, 5 and 6), projects upwardly within the tank chamber 24 as far as to closely below a horizontal tank wall 21″, while in the other embodiment, where the tank is located in a lower region of the housing 1, the nipple 20 projects approximately vertically over the upper, nearly horizontally extending wall 21′.

An insert 26, 26′, which is a setscrew with an outer thread, is located in a tube segment 25, 25′ adjoining the nipple 20, 20′. The outside diameter of this insert 26, 26′ corresponds to the inside diameter of the associated tube segment 25, 25′, while the diameter at the base of the thread pitch of the insert is somewhat smaller than the smallest inside diameter of the tube 18, 18′. Consequently only a labyrinth-like passage or opening 27, 27′ remains, which makes more difficult the passage of the fuel discharging from the tank chamber 24, 24′, at the same time however assures a sufficient air supply during underpressure in the tank chamber. In place of the setscrew, any other throttling, for instance a sinter insert, can also be used.

A further insert 29, 29′ is located in the other, free tube end 28, 28′; this further insert 29, 29′ is made the same as the insert in the connection region of the tube 18, 18′ at the nipple 20, 20′. In this way, a labyrinth-like passage or opening 30, 30′ is likewise formed in the free tube end 28, 28′; this labyrinth-like passage or opening makes the passage of fuel more difficult, and makes it possible to draw outside air into the tank chamber.

In order to prevent the threads of the labyrinth-like passage or opening 30, 30′ of the insert 29, 29′ from becoming clogged or obstructed by dust or dirt and thereby impairing or even cutting off the air access into the tank chamber 24, 24′, the tube 18, 18′ is placed in such a way that the free end 28, 28′ thereof is located in a space or chamber in which hardly any dirt or dust accumulates, or which is even closed off from the outside air. This space or chamber is therefore located as far as possible from the working tool or the guide bar 3, and the motor 5, and additionally far away from the tank chamber 24, 24′. The great distance from the tank chamber assures that the fuel has a long path to the passage or opening 30, 30′ at the free tube end 28, 28′, so that the fuel only seldom and in exceptional situations even comes at all as far as the region of this passage or opening and discharges therefrom. Even in such a situation there exists no danger whatever of fire because the free tube end 28, 28′ is located far away from the motor 5 and from the guide bar 3 so that an ignition via a spark formation or the like cannot occur.

After the insert 29, 29′ in the free tube end 28, 28′ comes very slightly or even not at all into engagement with the fuel, it is nearly impossible for the threads to clog with impurities from the fuel and impair the air access. Because of the considerable danger of contamination to which the insert 29, 29′ at the free tube end 28, 28′ is subjected even when it is far removed from the tool and from the motor—dust and dirt are also contained at a great distance in the drawn-in air—provision is made according to the present invention to protect the free tube end 28, 28′ by a covering or sheathing 31, 31′.

This covering at the same time protects the free tube ends 28, 28′ from damage by branches, underbrush, or the like to which the tube 18, 18′ is subjected, especially during forestry work.

The free tube end 28, 28′ moreover is also located externally of the handle region, so that fuel which possibly still discharges through the associated opening or passage 30, 30′ cannot drip on the hand of the operator.

For the purpose of making discharge of fuel even more difficult, the tube 18, 18′ passes at least once in an upward direction with respect to the normal position of the power chain saw, so that this tube segment forms a standpipe or riser in which the fuel must flow counter to the force of gravity. In both of the illustrated embodiments, this one riser segment 32, 32' merges into a further tube segment 33, 33' which is located approximately horizontally in the normal position of the saw, and which thereby forms a further standpipe or riser segment in the so-called felling position of the power chain saw.

Figure 2:
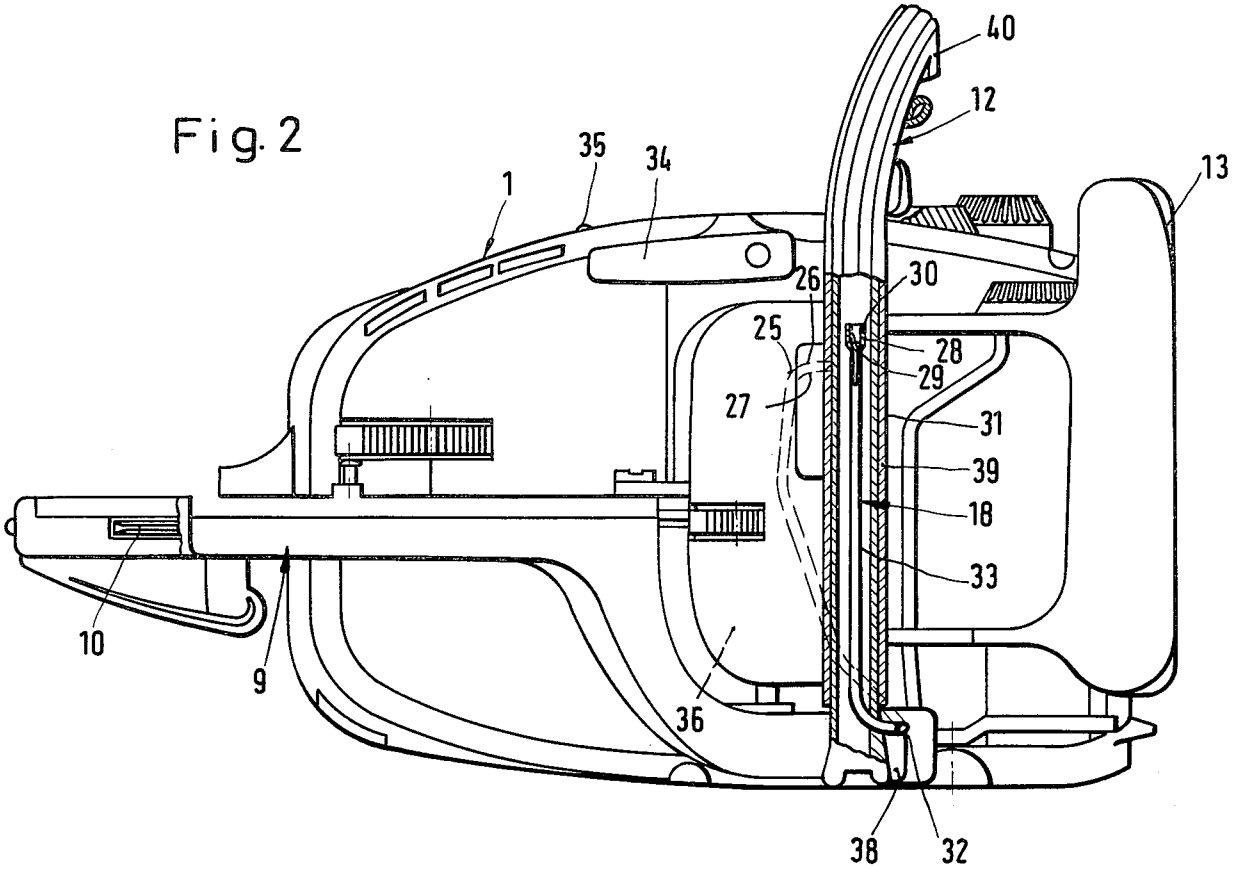
FIG. 2 is a plan view, partially in section, of the power chain saw of FIG. 1.

In the embodiment according to FIGS. 1 through 3, the tank 17 is located above the motor 5, and the nipple 20, on the housing side 35 adjacent to a starter lever 34, projects beyond the upper wall 21 (FIG. 3) into a chamber 36 (FIG. 2) located between the tank 17 and the handle 9. Within this chamber 36, the tube 18 is approximately horizontal as far as to the oppositely located chamber wall 37, through which it passes. The standpipe or riser segment 32 joins at this location for the normal position of the power chain saw; this segment 32 extends from the associated wall 37 (FIG. 3) upwardly through a vertical handle segment 38 and then extends further externally of the handle 12 upwardly into a horizontal, hollow grip or carrying part 39. The free tube end 28 is also located in this grip 39, and in particular adjacent to a second vertical and downwardly extending handle segment 40; the latter is fastened at 41 below the motor 5 and just above the housing bottom. The free end of this handle segment 40 is open, so that fuel discharging from the free tube end 28 can flow from the handle 12. The tube 18 can also be placed in such a way that the free end thereof projects into the vertical handle segment 40, where it is guided downwardly, as a result of which the fuel discharge is made even more difficult.

With this embodiment, the tube segment 33 located in the horizontal grip 39 forms the standpipe or riser for the felling position. Additionally, nearly the entire length of the tube 18 is located within a covering, namely the chamber 36 and the handle 12, so that the entire tube is extremely well protected and is accommodated in its prescribed position.

According to the embodiment of FIG. 4, the free tube end 28'' is accommodated in a further chamber 42 located above the tank 17, whereby the tube 18, as described, is guided via the first chamber 36 upwardly into the closed chamber 42 in conformity with the illustrations in FIGS. 1 and 2 of the drawings.

Figure 7:
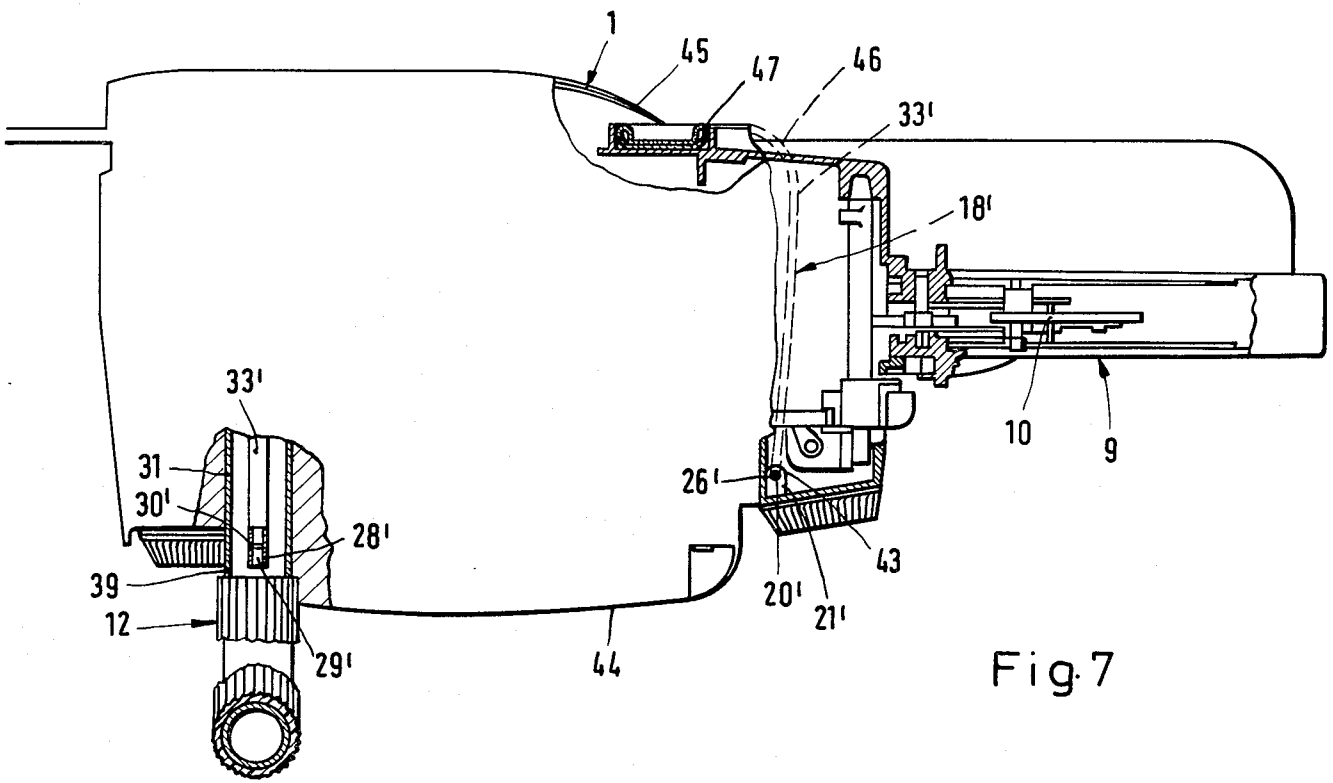
FIG. 7 is a plan view partially broken away and in section to illustrate the power chain saw according to FIGS. 5 and 6.

With the power chain saw according to FIGS. 5 through 7, where the tank 17' is located at the bottom of the housing 1, the tube 18' has a different position. There the nipple 20' is located on the upper tank wall 21', so that the tube 18', from the tank chamber 24' via a first vertical connection 32, is initially again guided from the one housing side 44 to the other housing side 45, where it leaves the housing 1. The tube 18' is then routed via the further vertical segment 46 (standpipe or riser) into the hollow handle 12, where it is guided via a relatively long inclined and upwardly extending handle segment 47 as far as into the horizontal grip or carrying part 39'. The free tube end 28' extends in this grip as far as to close to the oppositely located housing side 44. With this embodiment too, the tube segment 33' located in the horizontal grip 39' forms a riser or standpipe for the felling position. Especially expedient in the great length of the tube 18', and the two vertical tube segments 43 and 46, which form two risers in the felling position, so that the fuel discharge is extensively impossible. The tube segments 43 and 46 have a curved transition into each other and form an approximately U-shaped riser or standpipe with the horizontal segment 33', which makes the fuel discharge even more difficult.

In both of the described power chain saws, the tube 18, 18' can be placed not only in the handle 12 but also in the hand guard 13, without any essential change or worsening of the path of the tubes and their manner of operation.

The covering can also be formed by arranging a filter F, such as gauze or the like, behind the screws 27 and 29 as seen in the direction of the free tube end 28. The free tube end must then not necessarily be located in the handle or the chamber, so that only a portion of the tube is located in a chamber or a handle.

The construction and arrangement of the aerating and venting device of the tank according to the present invention can also be provided for other devices, such as for lawnmowers, hedge trimmers, lawn edgers, or the like.

The present invention is, of course, in no way restricted to the specific disclosure of the specification and drawings, but also encompasses any modifications within the scope of the appended claims.

What I claim is:

1. A hand-guided, motor driven working device having at least one tool, the device comprising:

a motor housing;

a carrying handle attached to said housing;

a fuel tank having a tank chamber;

a venting device operatively communicating with said fuel tank and including a flexible tube which projects from an upper part of said fuel tank and has a free end which is closed except for a labyrinth-like opening;

a covering defined by said carrying handle, said tube being arranged at least partially in said covering; and, a chamber located externally of said housing, said chamber being essentially free of dirt and being located as far as possible from said fuel tank, said tool, and said motor, said tube being guided to said dirt-free chamber.

2. A hand-held motor-driven chain saw comprising:

a housing;

moveable cutting tool means mounted with respect to said housing;

a fuel-driven motor mounted in said housing for driving said movable cutting tool means;

a fuel tank mounted in said housing and defining a tank chamber wherein the fuel is contained;

structure means associated with said housing for defining an essentially dirt-free chamber spaced away from said motor, said tool means and said fuel tank;

a venting arrangement for venting the tank, the device including: a flexible tube communicating with said tank chamber at the upper part thereof, the flexible tube having a free end disposed in said dirt-free chamber; and, labyrinth means mounted in said free end for sealing the same except for a labyrinth-like opening formed therein; and, said structure means including covering means for covering at least a portion of said flexible tube between said free end thereof and the end thereof communicating with said tank chamber whereby said flexible tube is protected against physical damage.

3. A chain saw according to claim 2, in which said tube includes at least two tube sections disposed at an angle to one another in such a way that at least one of said tube segments, in at least one operating position of said device, forms a riser for fuel leaving said tank chamber; and in which said free end of said tube is guided into said dirt-free chamber.

4. A chain saw according to claim 3, in which said tube includes at least two tube sections, with adjacent tube sections being disposed at right angles to one another.

5. A chain saw according to claim 4, which includes three tube sections disposed in such a way as to form a U-shaped tube.

6. A chain saw according to claim 2 said dirt-free chamber being located externally of said housing.

7. A chain saw according to claim 6, in which said free end of said tube projects into an open segment which in the out-of-operation state of said device opens below at least one of said motor and said tool.

8. A chain saw according to claim 6, which includes a hand guard, and a housing chamber which in the normal position of said device is disposed above said motor housing and between said fuel tank and said hand guard, with at least that tube segment which communicates with said fuel tank being disposed in said housing chamber.

9. A chain saw according to claim 2, in which said tube is disposed essentially completely within said covering means.

10. A chain saw according to claim 2, in which said free end of said tube is at least partially surrounded by a filter.

11. A chain saw according to claim 2, in which that segment of said tube which communicates with said fuel tank is provided with an insert which essentially completely fills the open cross section of said last-mentioned tube segment in such a way that at least one first labyrinth-like passage is formed for fuel and outside air.

12. A chain saw according to claim 2, in which said dirt-free chamber is located above said fuel tank, at least said free end of said tube being located in said chamber.

13. A hand-guided, motor driven working device having at least one tool, the device comprising:

a fuel tank having a tank chamber;

a venting device operatively communicating with said fuel tank and including a flexible tube which projects from an upper part of said fuel tank and has a free end which is closed except for a labyrinth-like opening;

a covering defining a protective guard, said tube being arranged at least partially in said covering; and, a chamber located externally of said housing, said chamber being essentially free of dirt and being located as far as possible from said fuel tank, said tool, and said motor, said tube being guided to said dirt-free chamber.

14. A hand-guided, motor driven working device having at least one tool, the device comprising:

a housing;

a fuel tank having a tank chamber;

a venting device operatively communicating with said fuel tank and including a flexible tube which projects from an upper part of said fuel tank and has a free end which is closed except for a labyrinth-like opening;

a covering defining a handle attached to said housing, said tube being arranged at least partially in said covering;

said carrying handle being U-shaped, with the cross-piece being in the form of a grip; and in which that end of said tube remote from said free end thereof opens at the greatest possible distance from said grip at the highest location of said fuel tank; and, a chamber located externally of said housing, said chamber being essentially free of dirt and being located as far as possible from said fuel tank, said tool, and said motor, said tube being guided to said dirt-free chamber.

15. A hand-guided, motor driven working device having at least one tool, said device comprising:

a fuel tank having a tank chamber; p1 a venting device operatively communicating with said fuel tank and including a flexible tank which projects from an upper part of said fuel tank and has a free end which is closed except for a labyrinth-like opening, that segment of said tube which communicates with said fuel tank being provided with an insert which essentially completely fills the open cross section of said last-mentioned tube segment in such a way that at least one first labyrinth-like passage is formed for fuel and outside air, said insert being an externally threaded screw having a diameter, measured at the base of the thread, which is slightly less than the smallest inside diameter of said tube;

a covering, said tube being arranged at least partially in said covering; and, a chamber which is essentially free of dirt and is located as far as possible from said fuel tank, said tool, and said motor, said tube being guided to said dirt-free chamber.

16. A hand-guided, motor driven working device having at least one tool, said device comprising:

a fuel tank having a tank chamber;

a venting device operatively communicating with said fuel tank and including a flexible tube which projects from an upper part of said fuel tank and has a free end which is closed except for a labyrinth-like opening, that segment of said tube which communicates with said fuel tank is provided with an insert which essentially completely fills the open cross section of said last-mentioned tube segment in such a way that at least one first labyrinth-like passage is formed for fuel and outside air, said labyrinth-like opening of said free end of said tube is in the form of a second passage, which is essentially identical to said first labyrinth-like passage;

a covering, said tube being arranged at least partially in said covering; and, a chamber which is essentially free of dirt and is located as far as possible from said fuel tank, said tool, and said motor, said tube being guided to said dirt-free chamber.

* * * * *

UNITED STATES PATENT AND TRADEMARK OFFICE

CERTIFICATE OF CORRECTION

PATENT NO. : 4,462,158

DATED : July 31, 1984

INVENTOR(S) : Anton Wehle

It is certified that error appears in the above-identified patent and that said Letters Patent is hereby corrected as shown below:

In column 1, line 65: delete "," between the words "open" and "locations".

In column 5, line 52: delete "32," and substitute -- 43, -- therefor.

In column 7, line 3: delete "device," and substitute -- chain saw, -- therefor.

In column 7, line 17: delete "device," and substitute -- chain saw, -- therefor.

In column 7, line 21: delete "device," and substitute -- chain saw, -- therefor.

In column 8, line 19: delete "pl".

In column 8, line 21: delete "tank" and substitute -- tube -- therefor.

Signed and Sealed this

*Twenty-sixth* Day of *March 1985*

[SEAL]

*Attest:*

DONALD J. QUIGG

*Attesting Officer*

*Acting Commissioner of Patents and Trademarks*